US007708280B2

(12) United States Patent
Friedman

(10) Patent No.: US 7,708,280 B2
(45) Date of Patent: May 4, 2010

(54) POKER GAME WITH VARIABLE PAYOUTS BASED ON PROBABILITIES OF WINNING

(75) Inventor: Stacy Friedman, Beaverton, OR (US)

(73) Assignee: Olympian Gaming LLC, Beaverton, OR (US)

( * ) Notice: Subject to any disclaimer, the term of this patent is extended or adjusted under 35 U.S.C. 154(b) by 155 days.

(21) Appl. No.: 11/737,753

(22) Filed: Apr. 20, 2007

(65) Prior Publication Data

US 2008/0258389 A1 Oct. 23, 2008

(51) Int. Cl.
*A63F 1/00* (2006.01)

(52) U.S. Cl. ..... 273/292

(58) Field of Classification Search ..... 273/292, 273/293

See application file for complete search history.

(56) References Cited

U.S. PATENT DOCUMENTS 6,170,827 B1 * 1/2001 Lombardo et al. ..... 273/292
6,446,972 B1 * 9/2002 Brunelle ..... 273/292
6,840,517 B2 * 1/2005 Snow et al. ..... 273/292
7,552,927 B2 * 6/2009 Moss ..... 273/274
2002/0137558 A1 * 9/2002 Hartl ..... 463/11
2005/0104293 A1 * 5/2005 Webb ..... 273/292

* cited by examiner

*Primary Examiner*—Gene Kim
*Assistant Examiner*—Amir Klayman
(74) *Attorney, Agent, or Firm*—Muskin & Cusick LLC

(57) ABSTRACT

A poker game wherein conditions for a player's hand(s) and a dealer's hand(s) are different such that the player may have different probabilities of winning than the dealer. Payouts are adjusted such that the player's hands are disadvantaged compared to the dealer (e.g., the dealer can have more cards in the dealer's hand) so that the player's payouts may be more than even money to compensate for long odds.

14 Claims, 6 Drawing Sheets

POKER GAME WITH VARIABLE PAYOUTS BASED ON PROBABILITIES OF WINNING

BACKGROUND OF THE INVENTION

1. Field of the Invention

The present general inventive concept is directed to a method, apparatus, and computer readable storage medium directed to a wagering game based on poker hands.

2. Description of the Related Art

Poker games are a very popular form of table games in a casino. Several poker-like table games have been recently successful in casinos. These include games such as 3 Card Poker and Caribbean Stud Poker. A disadvantage of these games is that there is only one way for the player to beat the dealer, that is if the player gets a higher ranked poker hand than the dealer, wherein the player wins a payout.

It would be desirable for a poker-like game to permit players to make wagers on different propositions with different chances of winning.

SUMMARY OF THE INVENTION

It is an aspect of the present invention to provide exciting variations of card games that can be played in casinos.

The above aspects can be obtained by a method that includes (a) providing a player with an opportunity to wager on at least one hand out of a first hand and a second hand, wherein the second hand has a characteristic which gives the second hand a higher probability of outranking a third hand upon revealing of all cards in the first hand and the second hand and the third hand than a probability of the first hand outranking the third hand; (b) receiving at least one wager from the player; (c) determining if the first hand is wagered on by the player, and if so, then revealing the first hand; (d) determining if the second hand is wagered on by the player, and if so, then revealing the second hand; (e) revealing the third hand; (f) determining if the first hand is wagered on by the player, and if so, then evaluating if the first hand outranks the third hand, and if so, then paying any wagers on the first hand at a first payout rate; and (g) determining if the second hand is wagered on by the player, and if so, then evaluating if the second hand outranks the third hand, and if so, then paying any wagers on the second hand at a second payout rate, (h) wherein the first payout rate is higher than the second payout rate.

The above aspects can also be obtained by a method that includes (a) receiving a wager from a player; (b) revealing a player's hand and a dealer's hand; (c) continuing to add revealed cards to the dealer's hand until the dealer's outranks the player's hand; and (d) resolving the wager based on a number of cards in the dealer's hand.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1A:
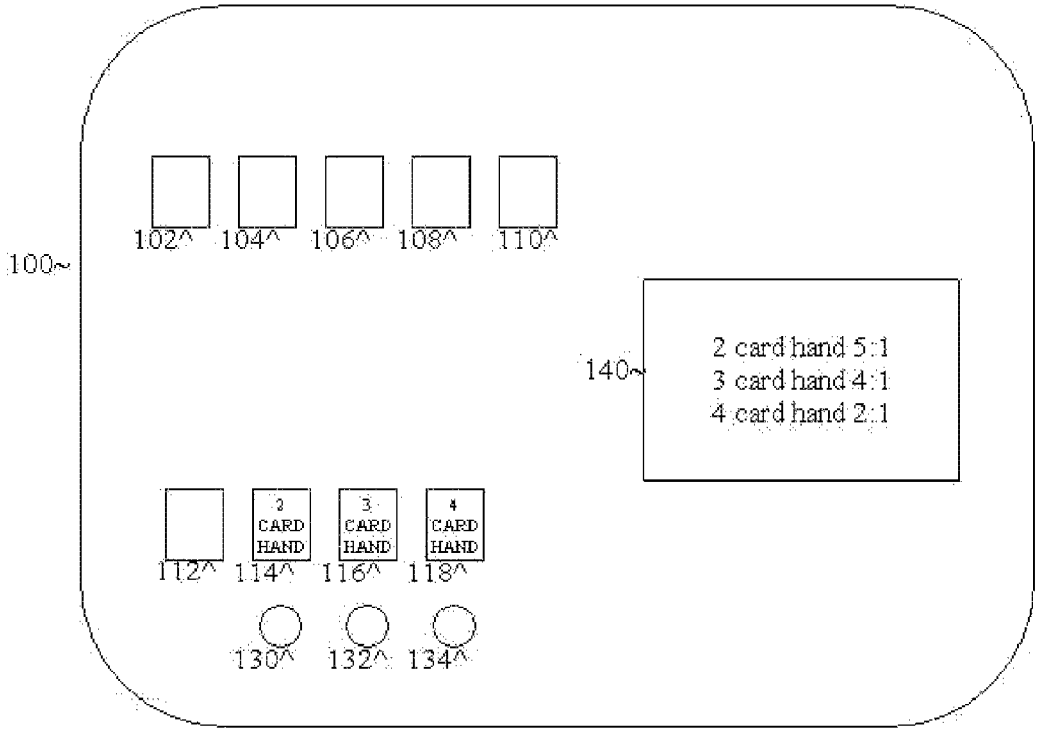
FIG. 1A is an exemplary table layout illustrating wagering on multiple card hands versus a dealer hand, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino to offer to player(s) a poker type game which can provide a player one or more wagers which can pay varying payouts based on probabilities of winning conditions for the respective wagers.

Embodiments described herein generally involve ranking poker hands and comparing competing ranked hands to each other to determined a higher ranked poker hand, which is typically the winner. Table I below represents just one example of how poker hands can be ranked, although of course any other methodology of ranking poker hands can be used as well. The lower number, the better, thus according to Table I, a Royal flush (number one) would beat a straight flush (number 2).

TABLE I

| Rank | Hand |
|---|---|
| 1 | Royal flush |
| 2 | Straight flush |
| 3 | Four of a kind |
| 4 | Full House |
| 5 | Flush |
| 6 | Straight |
| 7 | Three of a kind |
| 8 | Two pair |
| 9 | Pair |
| 9 | High card |

It is noted that in Table I, there can be ranks with ranks as well. For example, if hand A is a pair of 9's and hand B is a pair of 2's, since 9 is a higher rank than 2, hand A would have a higher rank than hand B. As known in poker, after reviewing all cards available to a particular hand, a hand is ranked by using the cards out of the available hand that can create the highest X card poker hand (X is typically 5, although it can be any other number of cards as well). Thus, if hand A comprises the following seven cards: ace of spades, ace of clubs, ace of diamonds, three of spades, four of spades, nine of clubs, and ten of hearts, the best five card poker hand would be ace spades/ace clubs/ace diamonds/ten hearts/nine of clubs, which would have a rank of three of a kind. The ten hearts and nine of clubs are used because these are the highest cards out of the bunch, so in case of a tie (e.g., another competing hand also has a rank of three aces {technically impossible if using a single standard 52 card deck}) then the highest card not in the three of a kind is used to break a tie (ten hearts). If that card also ties with the competing hand (extremely unlikely), then the last card is used (nine of clubs) to break a tie.

Certain ranks may not be active. For example, straights and flushes may not be allowed on any of the variations described herein. This may be necessary because of a hand is comprises of less than five cards, making a straight (consecutive cards) or a flush (cards of a same suit) may be too easy.

How to evaluate and rank poker hands is well known in the art, and such known methodology can be applied to any of the embodiments described herein. In a further embodiment, a lower ranked hand would beat a higher ranked hand (as opposed to the standard higher ranked hand beating a lower ranked hand).

Embodiments described herein relate to providing a player with various wagering opportunities to beat a dealer's hand (e.g., the player hopes his or her hand(s) will have a higher poker rank than the dealer's hand). The player can be presented with multiple hands to play against a dealer, who can also play a single or multiple hands as well.

FIG. 1A is an exemplary table layout illustrating wagering on multiple card hands versus a dealer hand, according to an embodiment.

A casino table 100 is used to deal a dealer's hand comprising a dealer's first card 102, a dealer's second card 104, a dealer's third card 106, a dealer's fourth card 108, and a dealer's fifth card 110, all combined to form the dealer's hand. The cards can be dealt initially face down and revealed after wagers are placed or they can be dealt face up after the wagers are placed.

A first player's card 112 and a second player's card 114 combine to form a player's two card hand. The first player's card 112 and the second player's card 114 and the third player's card 116 combine to form a player's three card hand. The first player's card 112 and the second player's card 114 and the third player's card 116 and the fourth player's card 118 combine to form a player's four card hand. Typically, all of the player's cards are not dealt (or dealt but not revealed) until the player has placed all of the player's wager(s).

A two card hand betting circle 130 can be used by the player to place a two card wager to bet on the player's two card hand. A three card hand betting circle 132 can be used by the player to place a three card wager to bet on the player's three card hand. A four card hand betting circle 134 can be used by the player to place a four card wager to bet on the player's four card hand.

The player may be required to bet on all the available bets (e.g., the two card betting circle 130, the three card betting circle 132, and the four card betting circle 134), or the player may place any combination of these wagers at the player's discretion.

A paytable 140 displays payouts for when the player wins each of the different hands (e.g., two card hand, three card hand, four card hand).

After the player places his or her wager(s), then all of the player's cards and the dealer's cards can be revealed. If the player's two card hand beats the dealer's hand then the player wins the two card wager using a payout shown on the paytable 140. If the player's three card hand beats the dealer's hand then the player then the player wins the three card wager using a payout shown on the paytable 140. If the player's four card hand beats the dealer's hand then the player wins the four card wager using a payout shown on the paytable 140.

Since in this example the dealer has five cards and the player can have two, three, or four cards, the dealer is more likely to have the higher hand. Since the player is more likely the beat the dealer using four cards than three, the payout for beating the dealer using three cards is higher than the payout for beating the dealer using four cards. The payouts used can reflect the probabilities of a player winning based on the conditions of the wager (e.g., number of cards the dealer has, number of cards the player has, any predetermined cards, etc.)

An example of how this game can be played is as follows. In this example, the only poker ranks (in order from best to worst) allowed are: four of a kind, three of a kind, two pair, pair, high card. Joe (the player) bets $1 on the two card wager, $2 on the three card wager, and $3 on the four card wager. Five cards are dealt to the dealer (3 spades/4 clubs/10 spades/9 hearts/3 clubs). Four cards are dealt to the player (9 diamonds/3 hearts/10 hearts/9 clubs). Joe's two card hand is: 9 diamonds/3 hearts which has a rank of 9 high. The dealer's hand rank (using all of the dealer's cards) is a pair of 3's. Thus, the dealer's hand beats the player's two card hand and Joe loses his two card wager. The player's three card hand is: 9 diamonds/3 hearts/10 hearts, for a rank of 10 high. The dealer's pair of 3's beats the player's three card hand and Joe loses his three card wager. The player's four card hand is: 9 diamonds/3 hearts/10 hearts/9 clubs, for a rank of a pair of 9's. The pair of 9's ranks higher than the dealer's pair of 3's, and thus Joe wins the four card wager. Since the payout on the four card wager is 2:1, Joe wins 2× his original bet of $3 or $6.

It is noted that of course any number of cards can be used for the player's and/or dealer's hand, any number of wagers can be provided to the player for any number of respective cards. It is also noted that some cards (either at least one player's card and/or at least one dealer's card) may be revealed to the player before wager(s) are placed or after an initial wager(s) is placed but before further wager(s) is placed. Further, instead if dealing all cards, any of the card values may be predetermined (e.g., a particular card must have a value of, for example, 8 hearts, and this value can even be printed on the game felt).

Figure 1B:
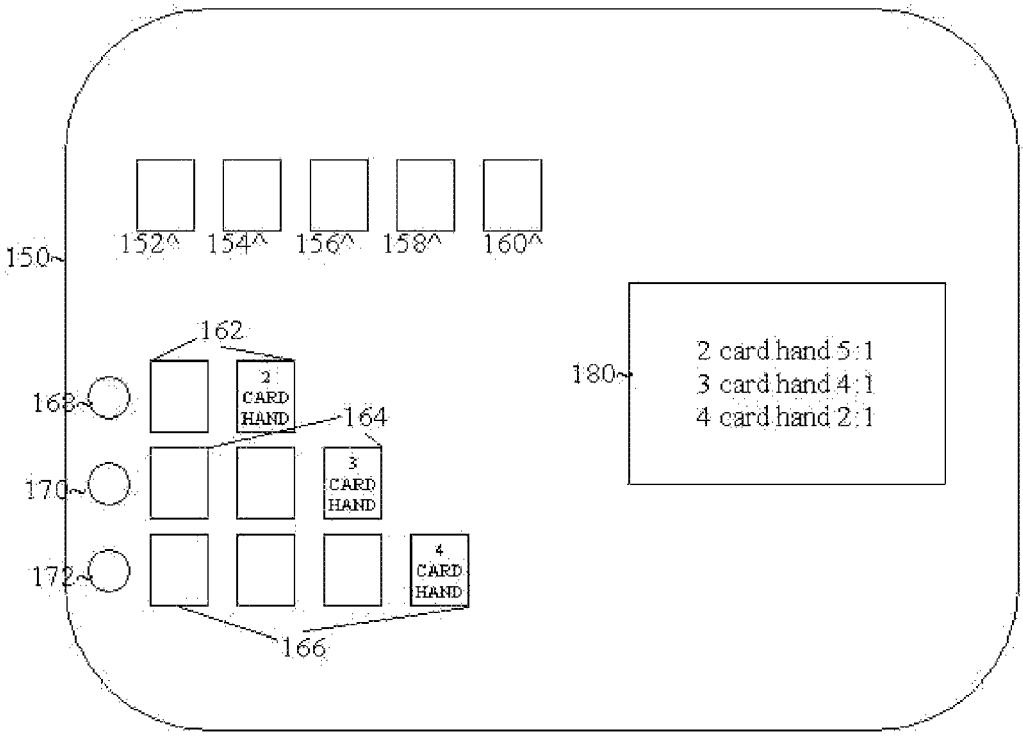
FIG. 1B is an exemplary table layout illustrating wagering on separate multiple card hands versus a dealer hand, according to an embodiment.

FIG. 1B is an exemplary table layout illustrating wagering on separate multiple card hands versus a dealer hand, according to an embodiment.

A casino table 150 is used to deal a dealer's hand comprising a dealer's first card 152, a dealer's second card 154, a dealer's third card 156, a dealer's fourth card 158, and a dealer's fifth card 160, all combined to form the dealer's hand. The cards can be dealt initially face down and revealed after wagers are placed or they can be dealt face up after the wagers are placed.

A player's two card hand 162, the player's three card hand 164, and the player's four card hand 166, are dealt. Typically, all of the player's cards are not dealt (or dealt but not revealed) until the player has placed all of the player's wager(s).

A two card hand betting circle 168 can be used by the player to place a two card wager to bet on the player's two card hand. A three card hand betting circle 170 can be used by the player to place a three card wager to bet on the player's three card hand. A four card hand betting circle 172 can be used by the player to place a four card wager to bet on the player's four card hand. A paytable 180 is used to display payouts (also known as payout rates), that is, what multiple of a wager is paid on a winning wager.

The same game rules as described with respect to FIG. 1A can be applied to FIG. 1B. The main difference is that in FIG. 1B, separate hands are dealt for each of the player's hands as opposed to using common cards to form the different player hand as in FIG. 1A. The expected player returns should remain the same for each version, but the win rates for each of the individual wagers in the same game in the FIG. 1A version would typically have a higher correlation (because hands share common cards) and thus an overall net win for multiple wagers would have a higher variance, than the FIG. 1B version, where it is more likely that one hand may win but another may lose.

Figure 2:
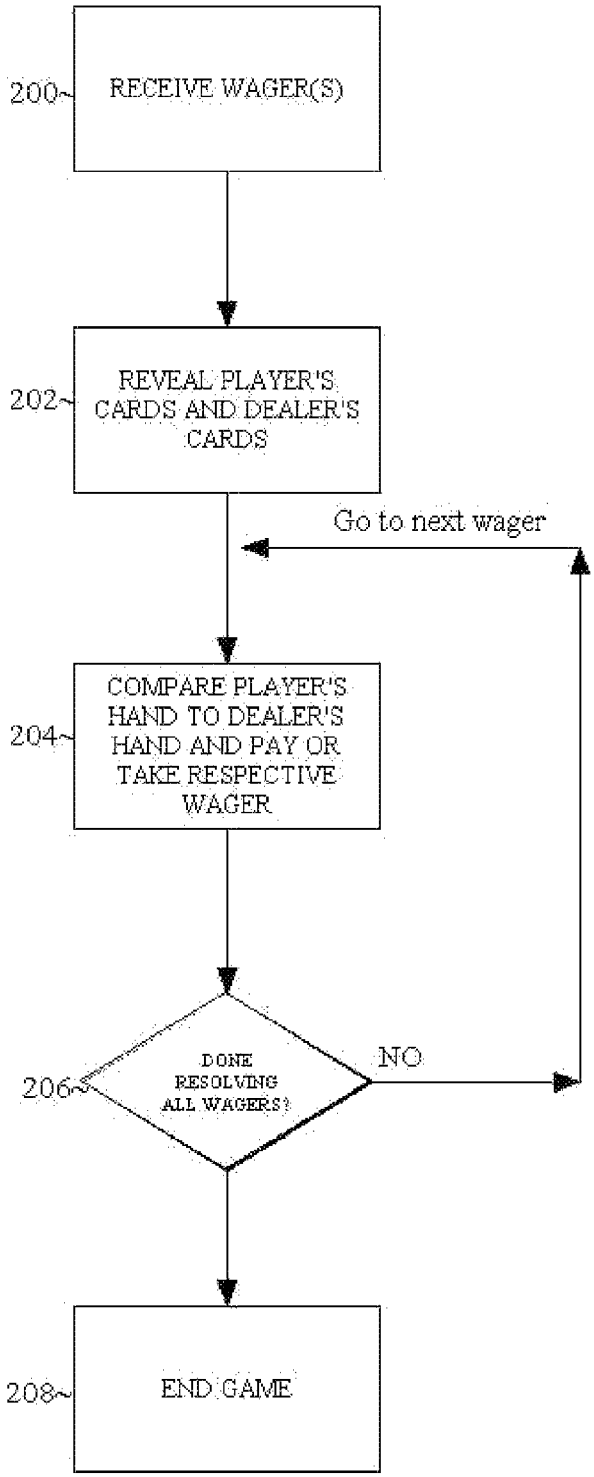
FIG. 2 is an exemplary flowchart illustrating a method to implement a wagering game involving multiple hands, according to an embodiment.

FIG. 2 is an exemplary flowchart illustrating a method to implement a wagering game involving multiple hands, according to an embodiment.

The method can begin with operation 200, which receives wager(s) from the player(s). The player(s) can place chips in respective betting circles at appropriate times, as known in the art.

From operation 200, the method can proceed to operation 202, wherein all player's cards and all dealer's cards are revealed. In a further embodiment, at least one dealer's card(s) and/or at least one player's card(s) can be revealed and then wager(s) can be accepted from the player(s), upon which all cards can then be revealed.

From operation 202, the method can proceed to operation 204, which compares a player's hand to the dealer's hand and determined which hand is a winner based on winning criteria or criterion (e.g., which hand has the highest standard poker rank value). If the dealer's hand has a poker rank that is higher than a poker rank of the player, then the player typically loses, while if the player's hand has the higher rank, then the player typically wins and the player's respective wager for that hand is paid accordingly.

From operation 204, the method proceeds to operation 206, which determines if all wagers have been resolved. Since multiple wagers/hands (either player or dealer) can be resolved using methods described herein, each wager must be evaluated individually and paid accordingly. If there are more wagers to resolve, then the method can proceed to operation 204 (and proceed to a next wager) so operation 204 can be applied to it.

If in operation 206 it is determined that all wagers have been resolved, then the method can proceed to operation 208, which ends the game. All winning wagers should be paid accordingly (according to their respective value according to a paytable, while all losing wagers are collected by the house). All of the cards can be collected and a new game can begin.

In a further embodiment, a player can wager on a number of cards a dealer will have to use before the dealer's best poker hand rank beats the player's best poker hand.

Figure 3:
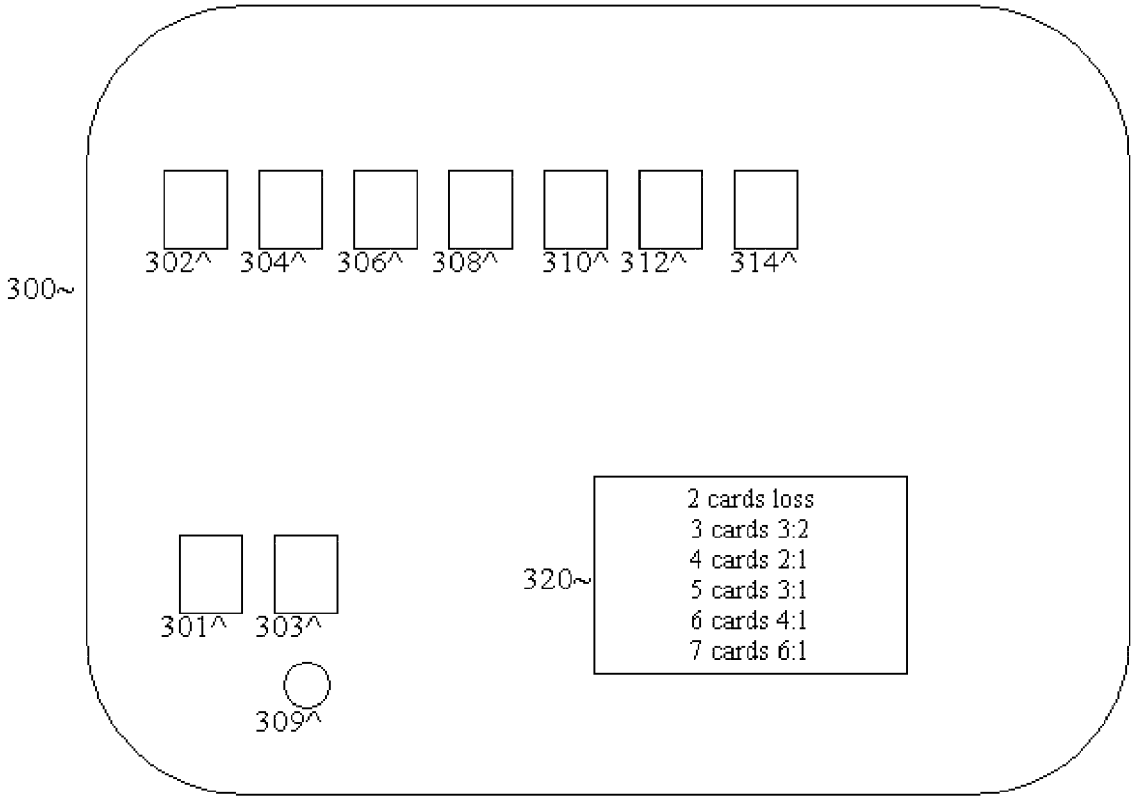
FIG. 3 is an exemplary table layout illustrating wagering on a number of cards required by a dealer to beat a player's hand(s), according to an embodiment.

FIG. 3 is an exemplary table layout illustrating wagering on a number of cards required by a dealer to beat a player's hand(s), according to an embodiment.

A table 300 is used to deal a dealer's hand comprising a first dealer's card 302, a second dealer's card 304, a third dealer's card 306, a fourth dealer's card 308, a fifth dealer's card 310, a sixth dealer's card 312, and a seventh dealer's card 314.

A player's hand comprises a first player's card 301 and a second player's card 303.

The player can place a wager in betting circle 309 that pays based on how many cards a dealer would have to use to beat the player. Paytable 320 can be used to determine how much the player's wager will pay based on how many cards the dealer had to use.

Figure 4:
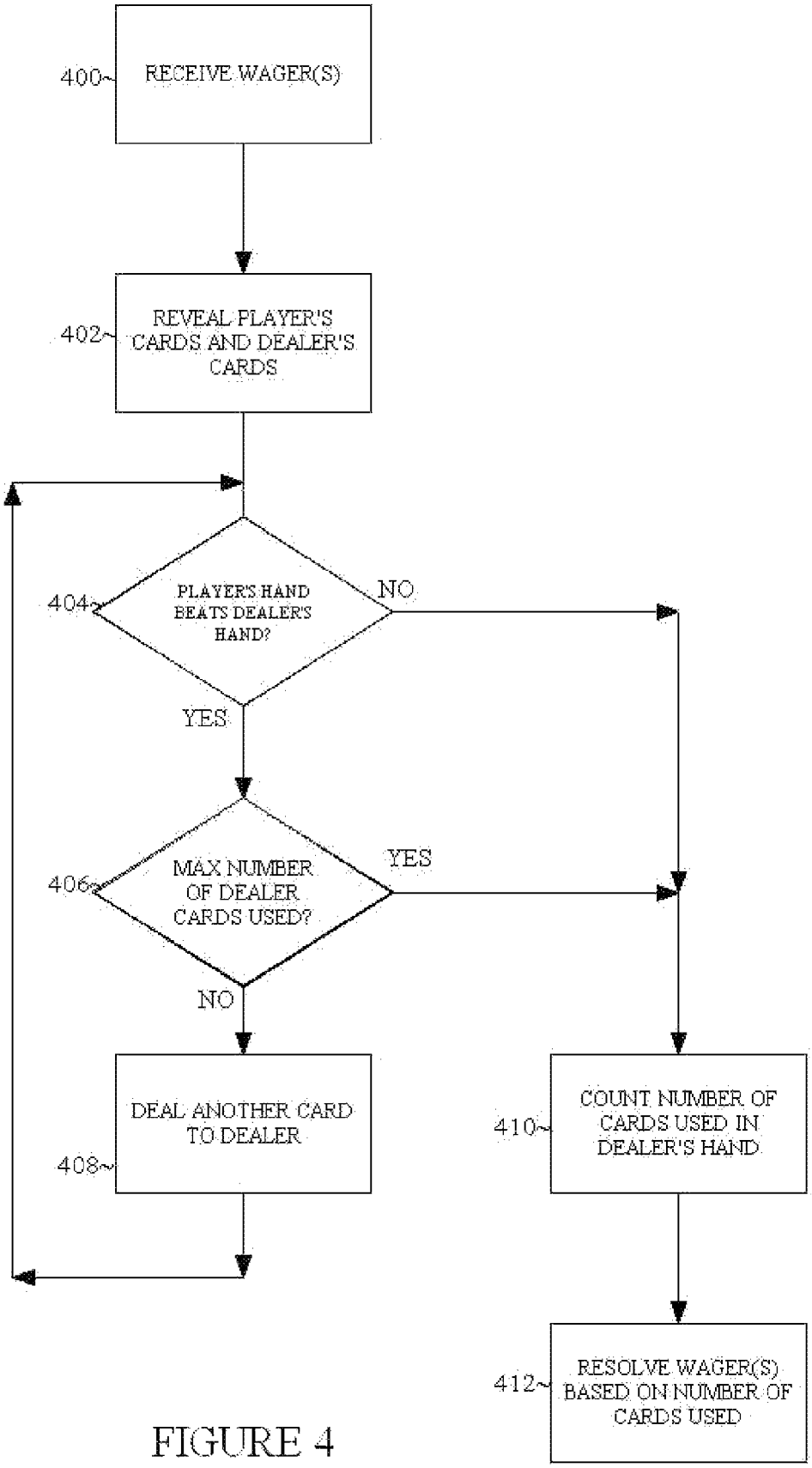
FIG. 4 is an exemplary flowchart illustrating a method of wagering on a number of cards required by a dealer to beat a player's hand(s), according to an embodiment.

FIG. 4 is an exemplary flowchart illustrating a method of wagering on a number of cards required by a dealer to beat a player's hand(s), according to an embodiment.

The method can begin with operation 400, which receives wager(s) from a player. For example, a single wager can be placed by the player. Alternatively, an ante wager can be placed by the player followed by an additional wager (or wagers) at a later point in the game From operation 400, the method can proceed to operation 402, which reveals player's card(s) and dealer's card(s). This can be considered the player's initial hand and the dealer's initial hand. For example, the player's initial hand can comprise two cards (although any number of cards can be used) which are revealed, and the dealer's initial hand can be revealed (for example, two cards, although any number of cards can be used).

From operation 402, the method can proceed to operation 404, which determines whether the player's hand beats (e.g., has a higher poker rank than) the dealer's hand. If the dealer currently has X cards, the dealer's best hand may be formed by taking the best hand which comprises Y cards from all of the X cards. For example, if the dealer has seven cards, the best dealers hand may be formed by taking the five cards out of the seven that will form the best five card hand. This five card hand is then compared to the player's hand. In an embodiment, certain ranks, such as (but not limited to) a straight and/or flush may only be used by the player and/or dealer if the hand has a minimum number of cards (e.g., 5), or alternatively certain ranks are not used at all (e.g., in an embodiment, straights and flushes do not count at all).

If the player's hand beats the dealer's hand then the method can proceed to operation 406, which determines whether a maximum number of dealer cards have been used. The casino may set a limit on the number of cards the dealer can use before the games ends (e.g., 7, etc.) Also, there may be a theoretical limit on a number of cards that can be dealt before it must beat a different N card hand.

If the determination in operation 406 determines that the dealer's hasn't yet used the maximum number of allowed cards, then the method can proceed to operation 408, which deals and reveals an additional card to the dealer. With each new card used by the dealer, the probability that the player's hand will still beat the dealer's hand will go down. The method can then return to operation 404.

If the determination in operation 404 determines that the player's hand does not beat the dealer's hand, or the determination in operation 406 determines that the maximum number of dealer cards have been used, then the method can proceed to operation 410 which counts a number of cards used in the dealer's hand. The player would typically want the number of cards in the dealer's hand to be as high as possible. There is an inverse correlation between the number of cards in the dealer's hand and the probability of this occurrence, and thus the more cards in the dealer's hand the higher the payout on the wager should typically be.

From operation 410, the method can proceed to operation 412, which resolves wager(s) based on the number of cards used by the dealer. A paytable can be used to determine the respective payouts. For example, if the player's initial hand does not beat the dealer's initial hand (e.g., operation 410 is reached when the dealer has only two cards), then no extra dealer cards need be dealt and this can be a losing wager for the player. If operation 410 is reached when the dealer has, for example, three cards, then the player may win a payout on his or her wager (e.g., 1:1, etc.) Of course, it can be appreciated that any number of cards can be used for any stage of the game. For example, the player's initial hand can be comprised of any number of cards, and the dealer's initial hand can be comprised of any number of cards.

An example of the embodiment illustrated in FIGS. 3 and 4 will now be presented. Bob places a $1 wager. Bob is then dealt a two card hand (Ace spades/Ace hearts). Bob is happy, as this is an excellent starting two card hand since it has the highest poker rank a two card hand can have (a pair of aces). The dealer's initial hand is now revealed: two clubs/three spades (which has a poker rank of 3 high). The dealer then deals himself another card, a ten of clubs. Now the dealer's poker hand rank is a 10 high, which still does not beat the player's rank of a pair of aces. The dealer then deals himself another card, a five of hearts. The dealer's poker hand rank is a 10 high, which still does not beat the player's rank of a pair of aces. The dealer then deals himself a five of clubs. The dealer's poker hand rank is a pair of 5's which does not beat the player's rank of a pair of aces. The dealer then deals himself a five of diamonds. The dealer's poker hand rank is three of a kind (5's) which beats the player's rank of a pair of aces. It is noted that the dealer now has six cards, and the poker rank of the dealer's hand can be determined by first taking the 5 cards out of the six that will give the dealer the best poker ranking, and then taking the rank of that hand. Thus, the dealer does not need to deal any additional cards and the wager can be resolved. The dealer has six cards and thus using a paytable (e.g., paytable 320 from FIG. 3), the player gets paid 4:1 on his wager, and thus Bob is paid $4.

If Bob's initial hand did not beat the dealer's initial hand, then the game could end and Bob would have lost his wager. In a further embodiment, a raise wager can be implemented as well, that is, after the player has viewed one or more dealer card(s) and/or one or more player card(s), the player can place a raise wager. Both wagers can then be resolved as described above, that is based on a number of dealer cards needed. If the player does not place the raise wager, then either the initial wager the player places will be resolved or the player will lose (or push) the initial wager if the player decides not to raise. The player may be required to place an ante wager for each of the individual player's hands and a corresponding raise wager for each of the individual player's hands, where the ante wager may be paid at even money (or using a different paytable than the raise wager); or, vice-versa.

In a variation of the embodiment illustrated in FIGS. 3 and 4 (and the accompanying description), the player may wager on different hands of the same size, but with different award schedules based on the number of dealer cards needed to determine the outcome. For example, in a game where the dealer will draw five cards, the player may wager on a two-card hand that wins awards if (a) it outranks all 5 dealer cards, (b) it outranks the first 4 dealer cards, or (c) it outranks the first 3 dealer cards. The player may also wager on a separate two-card hand that wins only if (a) it outranks all 5 dealer cards or (b) it outranks the first 4 dealer cards. In the latter case, the awards would typically be higher, though the chances of winning are smaller.

In a further embodiment, poker wagers can be placed as well, on the player's hand and/or the dealer's hand. The poker wagers can be separate wagers which simply pay according to a paytable based on a rank of the respective hand. Thus, a player can place a separate wager on what the best rank of the dealer's best five card hand will be when the game is over.

In a further embodiment, cards can be predetermined. For example, a particular card used by a player and/or a dealer can be fixed. For example, the first player's card can always be a king of clubs. The king of clubs may even be printed on the table felt to indicate this is a predetermined card. The deck of cards used may be a standard 52 card deck or it may have any predetermined card(s) removed (so it is not possibly to have two identical cards in play at the same time).

Figure 5:
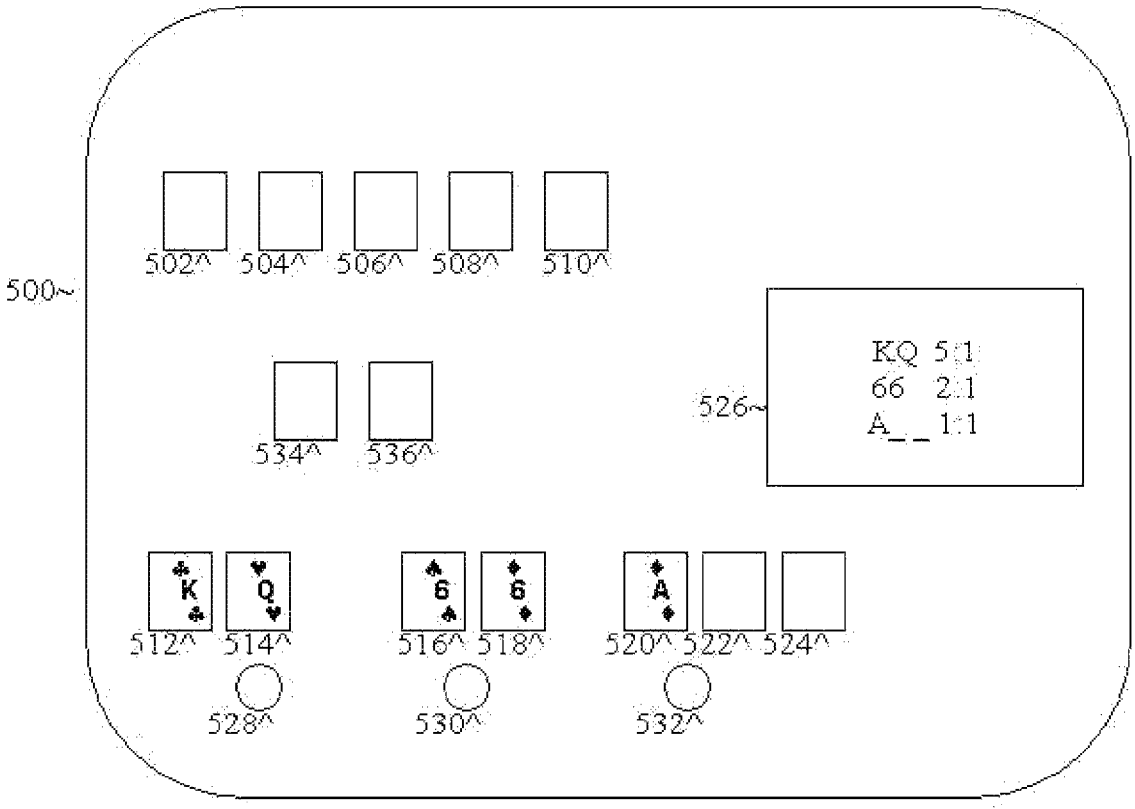
FIG. 5 is an exemplary table layout illustrating wagering on multiple player hands with predetermined cards, according to an embodiment.

FIG. 5 is an exemplary table layout illustrating wagering on multiple player hands with predetermined cards, according to an embodiment.

A table 500 is used to deal a dealer's hand comprising a first dealer's card 502, a second dealer's card 504, a third dealer's card 506, a fourth dealer's card 508, and a fifth dealer's card 510.

A player's first hand comprises a player's first hand first card 512 and a player's first hand second card 514. Note that both of these cards are predetermined (in other words, they are not dealt from the deck). A first hand wager betting circle 528 is used to receive a first wager on the player's first hand. A player's second hand comprises a player's second hand first card 516 and a player's second hand second card 518 (a pair of 6's). A second hand wager betting circle 530 is used to receive a second wager on the second player's hand. A player's third hand comprises a player's third hand first card 520 and a player's third hand second card 522 and a player's third hand third card 524. It is noted that the player's third hand first card is predetermined (an ace of diamonds), while the player's third hand second card 522 and the player's third hand third card 524 are still dealt randomly from the deck. A third hand wager betting circle 532 is used to receive a third wager on the third player's hand.

It is also noted that in this example, the size of the different players hand can be different (e.g., the players first and second hands are two cards while the player's third hand is three cards). A paytable 526 is used to designate what a winning payout would be for each of the player's hands. Optional community cards 534 and 536 (although of course any number of community cards can be used) may or may not (depending on the embodiment) be used by either the dealer and/or the player to improve their hand. Also, some player's hands may have predetermined cards while some may not (e.g., the player's second hand first card 516 and the player's second hand second card 518 may be dealt randomly instead of being predetermined).

After all cards are revealed (the dealer's cards in the dealer's hand and player's non-predetermined cards), each player's hand can be rank and compared to see if it has a higher poker rank than the dealer's hand. If a player's hand beats the dealer's hand, then the respective wager on that hand wins a payout according to a paytable.

An example of the embodiment illustrated in FIG. 5 will now be presented. In this example, no community cards are used. Tom bets $1 on the first player hand, $2 on the second player hand, and $3 on the third player hand. The dealer then reveals the player's third hand second card 522 to be an Ace of clubs and reveals the player's third hand third card 524 to be a three of clubs. The dealer then reveals the dealer's hand: two diamonds/seven clubs/seven hearts/10 spades/four hearts (for a rank of a pair of 7's). Tom's first hand has a rank of king high, which does not beat the dealer's rank of a pair of 7's, thus Tom loses his $1 wager on the first player hand. Tom's second hand is a pair of 6's which does not beat the dealer's rank of a pair of 7's, thus Tom loses his $2 wager on the second player hand. Tom's third hand has a rank of a pair of aces which does beat the dealer's rank of a pair of 7's (since aces are conventionally ranked higher than sevens), thus Tom wins a payout on the third wager. According to the paytable 526, the third hand (ace and two additional non-predetermined cards) pays 1:1, thus Tom wins $3 on the third wager. Thus, Tom has overall broken even on all three bets.

In a further embodiment, a single player's hand may be implemented. For example, all embodiments described herein can be applied to a game where just a single player's hand is used (instead of providing the player at least two hands to wager on).

Alternatively, hand rankings not based on traditional five-card poker hand rankings (described in Table I herein) may be used. Also, the best N cards in a hand may be used instead of all cards, where N is less than the total number of cards in a hand but not necessarily five. As an example of both these variations, the best three-card hand in a four or five-card hand may be used, and the common three-card poker hand rankings would be used to determine relative hand strength. Three-card poker hand rankings are an example of rankings different than those described in Table I. In such a game, a player holding a four-card hand with four Aces would thus lose to a dealer's five-card hand with the three of hearts, four of hearts, five of hearts, nine of clubs, and queen of clubs, because the three-card straight-flush in the latter hand outranks the three-of-a-kind when only the best three cards in these hands are used.

Figure 6:
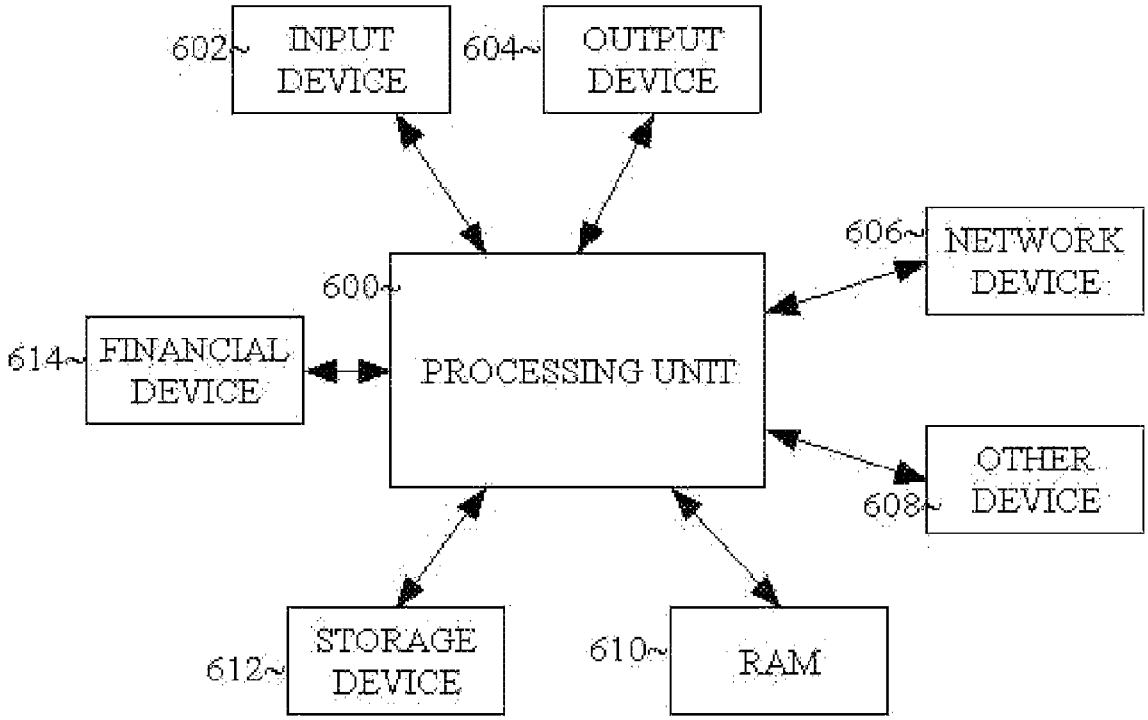
FIG. 6 is a block diagram illustrating an example of hardware used to implement an electronic gaming device (EGD), according to an embodiment.

FIG. 6 is a block diagram illustrating an example of hardware used to implement an electronic gaming device (EGD), according to an embodiment.

A processing unit 600 is connected to input device(s) 602 (which can be any combination of input devices, such as a keyboard, button(s), touch screen, etc.) The processing unit 600 is also connected to an output device 604, which can be any combination of output devices, such as an LCD display, touch screen, etc. The processing unit 600 is also connected to a network device 606, which can be used to connect the EGD to any type of network, such as a LAN and/or the Internet. The processing unit 600 can also be connected to any other device 608 which is known in the art and can be used to operate the EGD. The processing unit 600 is also connected to RAM 610, which can be used by the processing unit 600 in order to execute software which can implement programs used to play any embodiments described herein. The processing unit 600 is also connected to a storage device 612, which can be any type of storage device (e.g., ROM, CD-ROM, DVD, EPROM, etc.) which can store programs needed for implementation. The processing unit 600 can also be connected to a financial device 614 which can be used to process transactions, such as receiving payments (of cash or other form of payment) and making payments (cash or other form of payments).

Any embodiments described herein can be played with a standard deck of 52 cards or any type of special deck (e.g. a Spanish deck, etc.) All cards are dealt randomly. The game can also be played with a single deck or multiple decks (e.g. 1-8 decks or more). Further, the order of any of the operations described herein can be performed in any order and wagers can be placed/resolved in any order. Any operation can also be optional.

All embodiments described herein can also be played in electronic form including over the Internet on an electronic gaming machine (EGM) and programs and/or data for such can be stored on any type of computer readable storage medium (e.g. CD-ROM, DVD, disk, etc.)

Further cards can be dealt in any order and wagers can be resolved in any order. Whether a card is dealt face up, or a card is dealt face down and later on turned face up, is equivalent and be used herein interchangeably. The identifiers "player hand" and "dealer hand" are used to identify two different hands, but it can be appreciated that any two hands dealt in a game can be called by any other name as well "hand a," "hand 1," and the "player's hand" is not limited to a player and a "dealer's hand" is not limited to a dealer. Thus, just because a hand is called a "player's" hand does not necessarily mean it is to be associated with a player(s), and just because a hand is called a "dealer's hand" does not necessarily mean it is to be associated with a dealer. Further, all of the rules relating to "player hand" and "dealer hand" can also be reversed, e.g., the "dealer hand" can be played as the described "player hand" and vice-versa. Additionally, multiple players may wager on the outcome of a given hand, so that there may not be a 1-to-1 correspondence between the "player hands" dealt and the actual number of players. The number of cards used in each hand for the examples illustrated and described herein are merely exemplary, and it can be appreciated that hands comprising any number of cards can be used for the embodiments described herein. Wagers can also be placed at any point in time and after any number of player's cards and/or dealer's cards have been revealed.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game, the method comprising:

providing a physical deck(s) of cards:

providing a player with an opportunity to wager on at least one hand out of a first hand and a second hand, wherein the second hand has a characteristic which gives the second hand a higher probability of outranking a third hand upon revealing of all cards in the first hand and the second hand and the third hand than a probability of the first hand outranking the third hand, wherein the first hand and the second hand are dealt from the physical deck(s) of cards;

receiving at least one wager from the player;

determining if the first hand is wagered on by the player, and if so, then revealing the first hand;

determining if the second hand is wagered on by the player, and if so, then revealing the second hand;

revealing the third hand;

determining if the first hand is wagered on by the player, and if so, then evaluating if the first hand outranks the third hand, and if so, then paying any wagers on the first hand at a first payout rate; and determining if the second hand is wagered on by the player, and if so, then evaluating if the second hand outranks the third hand, and if so, then paying any wagers on the second hand at a second payout rate, wherein the first payout rate is higher than the second payout rate.

2. The method as recited in claim 1, wherein the operation of receiving at least one wager from the player requires the player to wager on least one specific hand.

3. The method as recited in claim 1, wherein the operation of receiving at least one wager from the player requires the player to wager on both the first hand and the second hand.

4. The method as recited in claim 1, wherein the operation of receiving at least one wager from the player allows the player to choose to wager on the first hand and/or the second hand.

5. The method as recited in claim 1, wherein the characteristic of the second hand is that the second hand has or will have at least one more card than the first hand.

6. The method as recited in claim 1, wherein the characteristic of the second hand is that the second hand has or will have a predetermined card.

7. The method as recited in claim 1, wherein the third hand comprises more cards than the second hand.

8. The method as recited in claim 5, wherein the third hand comprises more cards than the second hand.

9. The method as recited in claim 6, wherein the third hand comprises more cards than the second hand.

10. The method as recited in claim 1, wherein the second hand is formed by using cards from the first hand and adding at least one additional card.

11. The method as recited in claim 1, wherein the first hand and second hand are dealt as separate hands.

12. The method as recited in claim 1, wherein at least one of the first hand or the second hand comprises at least one predetermined card.

13. The method as recited in claim 1, wherein the third hand comprises at least one predetermined card.

14. A method to play on an electronic gaming machine comprising:

performing the following operations on electronic gaming machine using a processing unit providing a player with an opportunity to wager on at least one hand out of a first hand and a second hand, wherein the second hand has a characteristic which gives the second hand a higher probability of outranking a third hand upon revealing of all cards in the first hand and the second hand and the third hand than a probability of the first hand outranking the third hand;

receiving at least one wager from the player;

determining if the first hand is wagered on by the player, and if so, then revealing the first hand;

determining if the second hand is wagered on by the player, and if so, then revealing the second hand;

revealing the third hand;

determining if the first hand is wagered on by the player, and if so, then evaluating if the first hand outranks the third hand, and if so, then paying any wagers on the first hand at a first payout rate;

determining if the second hand is wagered on by the player, and if so, then evaluating if the second hand outranks the third hand, and if so, then paying any wagers on the second hand at a second payout rate, wherein the first payout rate is higher than the second payout rate; and outputting results of the processing unit using an output unit.

* * * * *